US006412282B1

(12) United States Patent
Willis

(10) Patent No.: US 6,412,282 B1
(45) **Date of Patent: *Jul. 2, 2002**

(54) COMBUSTION CHAMBER

(75) Inventor: Jeffrey D Willis, Coventry (GB)

(73) Assignee: Rolls-Royce plc, London (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/610,874

(22) Filed: Jul. 6, 2000

(30) Foreign Application Priority Data

Jul. 7, 1999 (GB) ..... 9915770

(51) Int. Cl.[7] ..... F02G 3/00
(52) U.S. Cl. ..... 60/737; 60/746
(58) Field of Search ..... 60/737, 746, 748, 60/760

(56) References Cited

U.S. PATENT DOCUMENTS

| | | | | |
|---|---|---|---|---|
| 5,596,873 A | | 1/1997 | Joshi | |
| 5,623,819 A | | 4/1997 | Bowker | |
| 5,628,192 A | * | 5/1997 | Hayes-Bradley et al. | 60/733 |
| 6,253,555 B1 | * | 7/2001 | Willis | 60/737 |

FOREIGN PATENT DOCUMENTS

| | | | |
|---|---|---|---|
| DE | 1246325 | A | 8/1967 |
| EP | 0 314 112 | A | 5/1989 |
| EP | 686 813 | A2 | 12/1995 |
| EP | 687 864 | A2 | 12/1995 |
| GB | 726491 | SP | 3/1955 |
| GB | 2 323 157 | A | 9/1998 |
| WOWO | PCT/GB91/01658 | A | 4/1992 |

* cited by examiner

*Primary Examiner*—Ehud Gartenberg
(74) *Attorney, Agent, or Firm*—W. Warren Taltavull; Manelli Denison & Selter PLLC

(57) ABSTRACT

A three stage lean burn combustion chamber (28) comprises a primary combustion zone (36), a secondary combustion zone (40) and a tertiary combustion zone (44). Each of the combustion zones (36,40,44) is supplied with premixed fuel and air by respective fuel and air mixing ducts (76,78,80, 92). The secondary fuel and air mixing duct (80) has passages (80A) and apertures (90A) at its downstream end to supply air and fuel into the secondary combustion zone (40) at a first position in the at least one combustion zone (40) and the secondary fuel and air mixing duct (80) has passages (80B) and apertures (90B) at its downstream end to supply air and fuel into the secondary combustion zone (40) at a second position in the secondary combustion zone (40) downstream from the first position. This axial distribution of fuel in the combustion zone (40) reduces the generation of harmful vibrations in the combustion chamber (28).

14 Claims, 3 Drawing Sheets

COMBUSTION CHAMBER

THE FIELD OF THE INVENTION

The present invention relates generally to a combustion chamber, particularly to a gas turbine engine combustion chamber.

BACKGROUND OF THE INVENTION

In order to meet the emission level requirements, for industrial low emission gas turbine engines, staged combustion is required in order to minimise the quantity of the oxide of nitrogen (NOx) produced. Currently the emission level requirement is for less than 25 volumetric parts per million of NOx for an industrial gas turbine exhaust. The fundamental way to reduce emissions of nitrogen oxides is to reduce the combustion reaction temperature, and this requires premixing of the fuel and all the combustion air before combustion occurs. The oxides of nitrogen (NOx) are commonly reduced by a method which uses two stages of fuel injection. Our UK patent no. GB1489339 discloses two stages of fuel injection. Our International patent application no. WO92/07221 discloses two and three stages of fuel injection. In staged combustion, all the stages of combustion seek to provide lean combustion and hence the low combustion temperatures required to minimise NOx. The term lean combustion means combustion of fuel in air where the fuel to air ratio is low, i.e. less than the stoichiometric ratio. In order to achieve the required low emissions of NOx and CO it is essential to mix the fuel and air uniformly.

The industrial gas turbine engine disclosed in our International patent application no. WO92/07221 uses a plurality of tubular combustion chambers, whose axes are arranged in generally radial directions. The inlets of the tubular combustion chambers are at their radially outer ends, and transition ducts connect the outlets of the tubular combustion chambers with a row of nozzle guide vanes to discharge the hot gases axially into the turbine sections of the gas turbine engine. Each of the tubular combustion chambers has two coaxial radial flow swirlers which supply a mixture of fuel and air into a primary combustion zone. An annular secondary fuel and air mixing duct surrounds the primary combustion zone and supplies a mixture of fuel and air into a secondary combustion zone.

One problem associated with gas turbine engines is caused by pressure fluctuations in the air, or gas, flow through the gas turbine engine. Pressure fluctuations in the air, or gas, flow through the gas turbine engine may lead to severe damage, or failure, of components if the frequency of the pressure fluctuations coincides with the natural frequency of a vibration mode of one or more of the components. These pressure fluctuations may be amplified by the combustion process and under adverse conditions a resonant frequency may achieve sufficient amplitude to cause severe damage to the combustion chamber and the gas turbine engine.

It has been found that gas turbine engines which have lean combustion are particularly susceptible to this problem. Furthermore it has been found that as gas turbine engines which have lean combustion reduce emissions to lower levels by achieving more uniform mixing of the fuel and the air, the amplitude of the resonant frequency becomes greater. It is believed that the amplification of the pressure fluctuations in the combustion chamber occurs because the heat released by the burning of the fuel occurs at a position in the combustion chamber which corresponds to an antinode, or pressure peak, in the pressure fluctuations.

SUMMARY OF THE INVENTION

Accordingly the present invention seeks to provide a combustion chamber which reduces or minimises the above mentioned problem.

Accordingly the present invention provides a gas turbine engine combustion chamber comprising at least one combustion zone being defined by at least one peripheral wall, at least one fuel and air mixing duct for supplying air and fuel respectively into the combustion zone, the at least one fuel and air mixing duct having at least one first means at its downstream end to supply air and fuel into the at least one combustion zone at a first position in the at least one combustion zone and at least one second means at its downstream end to supply air and fuel into the at least one combustion zone at a second position in the at least one combustion zone, wherein the second position is downstream from the first position to increase the distribution of fuel and air discharged from the fuel and air mixing duct into the combustion zone to increase the distribution of heat released from the combustion process whereby the amplitude of the pressure fluctuation is reduced.

Preferably the distance between the first and second positions is substantially equal to the velocity of gas flow multiplied by half of the time period of one cycle of the pressure fluctuation of a predetermined frequency to reduce the amplitude of the pressure fluctuation at the predetermined frequency.

The combustion chamber may comprise a primary combustion zone and a secondary combustion zone downstream of the primary combustion zone.

The combustion chamber may comprise a primary combustion zone, a secondary combustion zone downstream of the primary combustion zone and a tertiary combustion zone downstream of the secondary combustion zone.

Preferably the at least one fuel and air mixing duct supplies fuel and air into the secondary combustion zone.

The at least one fuel and air mixing duct may supply fuel and air into the tertiary combustion zone.

The at least one fuel and air mixing duct may supply fuel and air into the primary combustion zone.

The at least one fuel and air mixing duct may comprise a plurality of fuel and air mixing ducts.

Preferably the at least one fuel and air mixing duct comprises a single annular fuel and air mixing duct.

The at least one fuel and air mixing duct may have at least one third means at its downstream end to supply air and fuel into the at least one combustion zone at a third position in the at least one combustion zone, wherein the third position is downstream of the first position and upstream of the second position.

The at least one fuel and air mixing duct may have at least one fourth means at its downstream end to supply air and fuel into the at least one combustion zone at a fourth position in the at least one combustion zone, wherein the fourth position is downstream of the third position and upstream of the second position.

The at least one fuel and air mixing duct may have at least one fifth means at its downstream end to supply air and fuel into the at least one combustion zone at a fifth position in the at least one combustion zone, wherein the fifth position is downstream from the fourth position and upstream of the second position.

The first means may direct the fuel and air mixture into the at least one combustion zone at an angle of 50° and the third means directs the fuel and air mixture into the at least one combustion zone at an angle of 30°.

The first means and the second means may be arranged alternately around the peripheral wall.

The first means may direct the fuel and air mixture into the at least one combustion zone at an angle of 55° and the third means directs the fuel and air mixture into the at least one combustion zone at an angle of 45°, the fourth means directs the fuel and air mixture into the at least one combustion zone at an angle of 35° and the second means directs the fuel and air mixture into the at least one combustion zone at an angle of 25°.

The first means may direct the fuel and air mixture into the at least one combustion zone at an angle of 50° and the third means directs the fuel and air mixture into the at least one combustion zone at an angle of 45°, the fourth means directs the fuel and air mixture into the at least one combustion zone at an angle of 40°, the fifth means directs the fuel and air mixture into the at least one combustion zone at an angle of 35° and the second means directs the fuel and air mixture into the at least one combustion zone at an angle of 30°.

The first means, second means and third means may be arranged alternately around the peripheral wall.

The first means, the second means, the third means and the fourth means may be arranged alternately around the peripheral wall.

The first means, the second means, the third means, the fourth means and the fifth means may be arranged alternately around the peripheral wall.

BRIEF DESCRIPTION OF THE DRAWINGS

The present invention will be more fully described by way of example with reference to the accompanying drawings, in which.

DETAILED DESCRIPTION OF THE INVENTION

Figure 1:
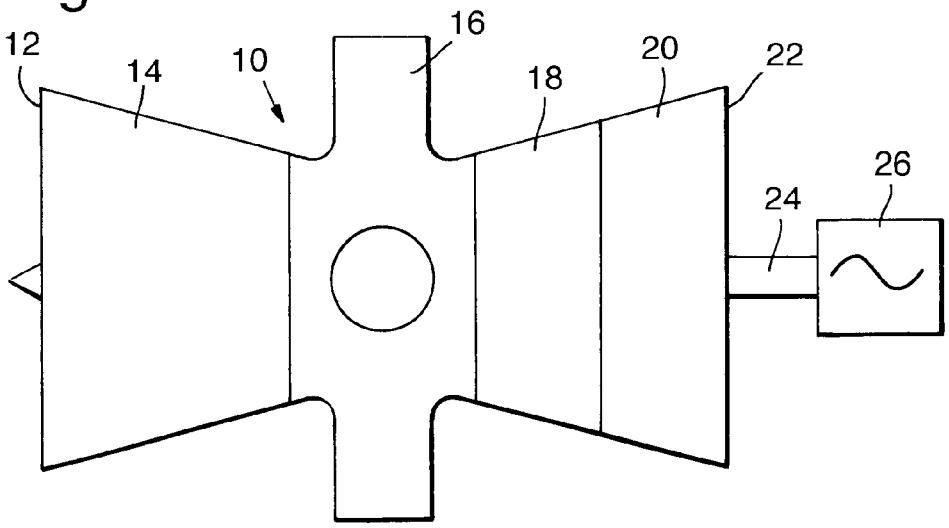
FIG. 1 is a view of a gas turbine engine having a combustion chamber according to the present invention.

An industrial gas turbine engine 10, shown in FIG. 1, comprises in axial flow series an inlet 12, a compressor section 14, a combustion chamber assembly 16, a turbine section 18, a power turbine section 20 and an exhaust 22. The turbine section 20 is arranged to drive the compressor section 14 via one or more shafts (not shown). The power turbine section 20 is arranged to drive an electrical generator 26 via a shaft 24. However, the power turbine section 20 may be arranged to provide drive for other purposes. The operation of the gas turbine engine 10 is quite conventional, and will not be discussed further.

Figure 2:
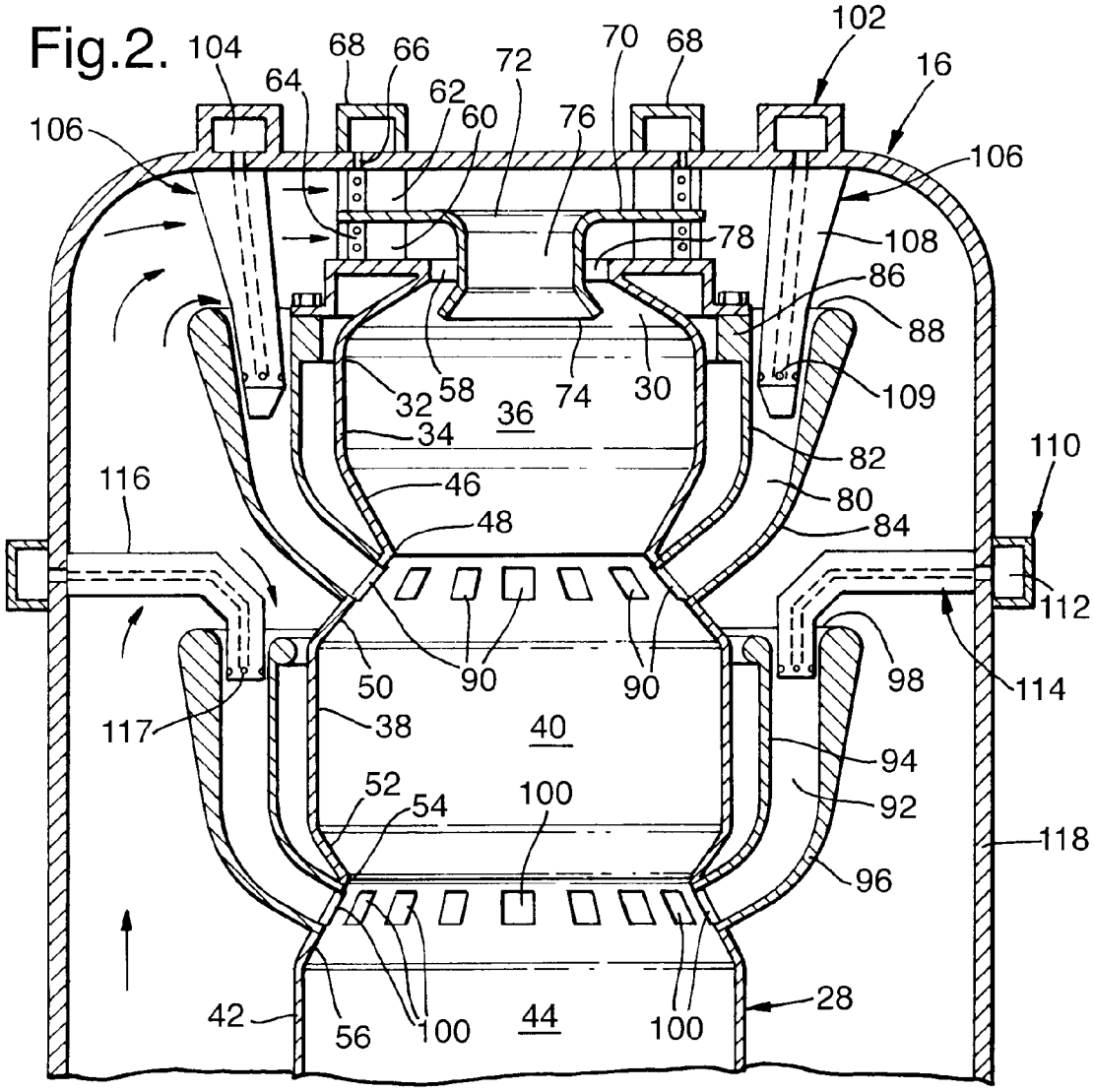
FIG. 2 is an enlarged longitudinal cross-sectional view through the combustion chamber shown in FIG. 1.

The combustion chamber assembly 16 is shown more clearly in FIG. 2. The combustion chamber assembly 16 comprises a plurality of, for example nine, equally circumferentially spaced tubular combustion chambers 28. The axes of the tubular combustion chambers 28 are arranged to extend in generally radial directions. The inlets of the tubular combustion chambers 28 are at their radially outermost ends and their outlets are at their radially innermost ends.

Each of the tubular combustion chambers 28 comprises an upstream wall 30 secured to the upstream end of an annular wall 32. A first, upstream, portion 34 of the annular wall 32 defines a primary combustion zone 36, a second, intermediate, portion 38 of the annular wall 32 defines a secondary combustion zone 40 and a third, downstream, portion 42 of the annular wall 32 defines a tertiary combustion zone 44. The second portion 38 of the annular wall 32 has a greater diameter than the first portion 34 of the annular wall 32 and similarly the third portion 42 of the annular wall 32 has a greater diameter than the second portion 38 of the annular wall 32. The downstream end of the first portion 34 has a first frustoconical portion 46 which reduces in diameter to a throat 48. A second frustoconical portion 56 interconnects the throat 48 and the upstream end of the second portion 38. The downstream end of the second portion 38 has a third frustoconical portion 52 which reduces in diameter to a throat 54. A fourth frustoconical portion 56 interconnects the throat 54 and the upstream end of the third portion 42.

A plurality of equally circumferentially spaced transition ducts are provided, and each of the transition ducts has a circular cross-section at its upstream end. The upstream end of each of the transition ducts is located coaxially with the downstream end of a corresponding one of the tubular combustion chambers 28, and each of the transition ducts connects and seals with an angular section of the nozzle guide vanes.

The upstream wall 30 of each of the tubular combustion chambers 28 has an aperture 58 to allow the supply of air and fuel into the primary combustion zone 36. A first radial flow swirler 60 is arranged coaxially with the aperture 58 and a second radial flow swirler 62 is arranged coaxially with the aperture 58 in the upstream wall 30. The first radial flow swirler 60 is positioned axially downstream, with respect to the axis of the tubular combustion chamber 28, of the second radial flow swirler 62. The first radial flow swirler 60 has a plurality of fuel injectors 64, each of which is positioned in a passage formed between two vanes of the radial flow swirler 60. The second radial flow swirler 62 has a plurality of fuel injectors 66, each of which is positioned in a passage formed between two vanes of the radial flow swirler 62. The first and second radial flow swirlers 60 and 62 are arranged such that they swirl the air in opposite directions. The first and second radial flow swirlers 60 and 62 share a common side plate 70, the side plate 70 has a central aperture 72 of arranged coaxially with the aperture 58 in the upstream wall 30. The side plate 70 has a shaped annular lip 74 which extends in a downstream direction into the aperture 58. The lip 74 defines an inner primary fuel and air mixing duct 76 for the flow of the fuel and air mixture from the first radial flow swirler 60 into the primary combustion zone 36 and an outer primary fuel and air mixing duct 78 for the flow of the fuel and air mixture from the second radial flow swirler 62 into the primary combustion zone 36. The lip 74 turns of the fuel and air mixture flowing from the first and second radial flow swirlers 60 and 62 from a radial direction to an axial direction. The primary fuel and air is mixed together in the passages between the vanes of the first and second radial flow swirlers 60 and 62 and in the primary fuel and air mixing ducts 76 and 78. The fuel injectors 64 and 66 are supplied with the fuel from primary fuel manifold 68.

An annular secondary fuel and air mixing duct 80 is provided for each of the tubular combustion chambers 28. Each secondary fuel and air mixing duct 80 is arranged circumferentially around the primary combustion zone 36 of the corresponding tubular combustion chamber 28. Each of the secondary fuel and air mixing ducts 80 is defined between a second annular wall 82 and a third annular wall 84. The second annular wall 82 defines the inner extremity of the secondary fuel and air mixing duct 80 and the third annular wall 84 defines the outer extremity of the secondary fuel and air mixing duct 80. The axially upstream end 86 of the second annular wall 82 is secured to a side plate of the first radial flow swirler 60. The axially upstream ends of the second and third annular walls 82 and 84 are substantially in the same plane perpendicular to the axis of the tubular combustion chamber 28. The secondary fuel and air mixing duct 80 has a secondary air intake 88 defined radially between the upstream end of the second annular wall 82 and the upstream end of the third annular wall 84.

At the downstream end of the secondary fuel and air mixing duct 80, the second and third annular walls 82 and 84 respectively are secured to the second frustoconical portion 50 and the second frustoconical portion 50 is provided with a plurality of apertures 90. The apertures 90 are arranged to direct the fuel and air mixture into the secondary combustion zone 40 in a downstream direction towards the axis of the tubular combustion chamber 28. The apertures 90 may be circular or slots and are of equal flow area.

The secondary fuel and air mixing duct 80 reduces in cross-sectional area from the intake 88 at its upstream end to the apertures 90 at its downstream end. The shape of the secondary fuel and air mixing duct 80 produces an accelerating flow through the duct 80 without any regions where recirculating flows may occur.

An annular tertiary fuel and air mixing duct 92 is provided for each of the tubular combustion chambers 28. Each tertiary fuel and air mixing duct 92 is arranged circumferentially around the secondary combustion zone 40 of the corresponding tubular combustion chamber 28. Each of the tertiary fuel and air mixing ducts 92 is defined between a fourth annular wall 94 and a fifth annular wall 96. The fourth annular wall 94 defines the inner extremity of the tertiary fuel and air mixing duct 92 and the fifth annular wall 96 defines the outer extremity of the tertiary fuel and air mixing duct 92. The axially upstream ends of the fourth and fifth annular walls 94 and 96 are substantially in the same plane perpendicular to the axis of the tubular combustion chamber 28. The tertiary fuel and air mixing duct 92 has a tertiary air intake 98 defined radially between the upstream end of the fourth annular wall 94 and the upstream end of the fifth annular wall 96.

At the downstream end of the tertiary fuel and air mixing duct 92, the fourth and fifth annular walls 94 and 96 respectively are secured to the fourth frustoconical portion 56 and the fourth frustoconical portion 56 is provided with a plurality of apertures 100. The apertures 100 are arranged to direct the fuel and air mixture into the tertiary combustion zone 44 in a downstream direction towards the axis of the tubular combustion chamber 28. The apertures 100 may be circular or slots and are of equal flow area.

The tertiary fuel and air mixing duct 92 reduces in cross-sectional area from the intake 98 at its upstream end to the apertures 100 at its downstream end. The shape of the tertiary fuel and air mixing duct 92 produces an accelerating flow through the duct 92 without any regions where recirculating flows may occur.

A plurality of secondary fuel systems 102 are provided, to supply fuel to the secondary fuel and air mixing ducts 80 of each of the tubular combustion chambers 28. The secondary fuel system 102 for each tubular combustion chamber 28 comprises an annular secondary fuel manifold 104 arranged coaxially with the tubular combustion chamber 28 at the upstream end of the tubular combustion chamber 28. Each secondary fuel manifold 104 has a plurality, for example thirty two, of equi-circumferentially spaced secondary fuel injectors 106. Each of the secondary fuel injectors 106 comprises a hollow member 108 which extends axially with respect to the tubular combustion chamber 28, from the secondary fuel manifold 104 in a downstream direction through the intake 88 of the secondary fuel and air mixing duct 80 and into the secondary fuel and air mixing duct 80. Each hollow member 108 extends in a downstream direction along the secondary fuel and air mixing duct 80 to a position, sufficiently far from the intake 88, where there are no recirculating flows in the secondary fuel and air mixing duct 80 due to the flow of air into the duct 80. The hollow members 108 have a plurality of apertures 109 to direct fuel circumferentially towards the adjacent hollow members 108. The secondary fuel and air mixing duct 80 and secondary fuel injectors 106 are discussed more fully in our European patent application EP0687864A.

A plurality of tertiary fuel systems 110 are provided, to supply fuel to the tertiary fuel and air mixing ducts 92 of each of the tubular combustion chambers 28. The tertiary fuel system 110 for each tubular combustion chamber 28 comprises an annular tertiary fuel manifold 112 positioned outside a casing 118, but may be positioned inside the casing 118. Each tertiary fuel manifold 112 has a plurality, for example thirty two, of equi-circumferentially spaced tertiary fuel injectors 114. Each of the tertiary fuel injectors 114 comprises a hollow member 116 which extends initially radially and then axially with respect to the tubular combustion chamber 28, from the tertiary fuel manifold 112 in a downstream direction through the intake 98 of the tertiary fuel and air mixing duct 92 and into the tertiary fuel and air mixing duct 92. Each hollow member 116 extends in a downstream direction along the tertiary fuel and air mixing duct 92 to a position, sufficiently far from the intake 98, where there are no recirculating flows in the tertiary fuel and air mixing duct 92 due to the flow of air into the duct 92. The hollow members 116 have a plurality of apertures 117 to direct fuel circumferentially towards the adjacent hollow members 117.

As discussed previously the fuel and air supplied to the combustion zones is premixed and each of the combustion zones is arranged to provide lean combustion to minimise NOx. The products of combustion from the primary combustion zone 36 flow through the throat 48 into the secondary combustion zone 40 and the products of combustion from the secondary combustion zone 40 flow through the throat 54 into the tertiary combustion zone 44. Due to pressure fluctuations in the air flow into the tubular combustion chambers 28, the combustion process amplifies the pressure fluctuations for the reasons discussed previously and may cause components of the gas turbine engine to become damaged if they have a natural frequency of a vibration mode coinciding with the frequency of the pressure fluctuations.

Figure 3:
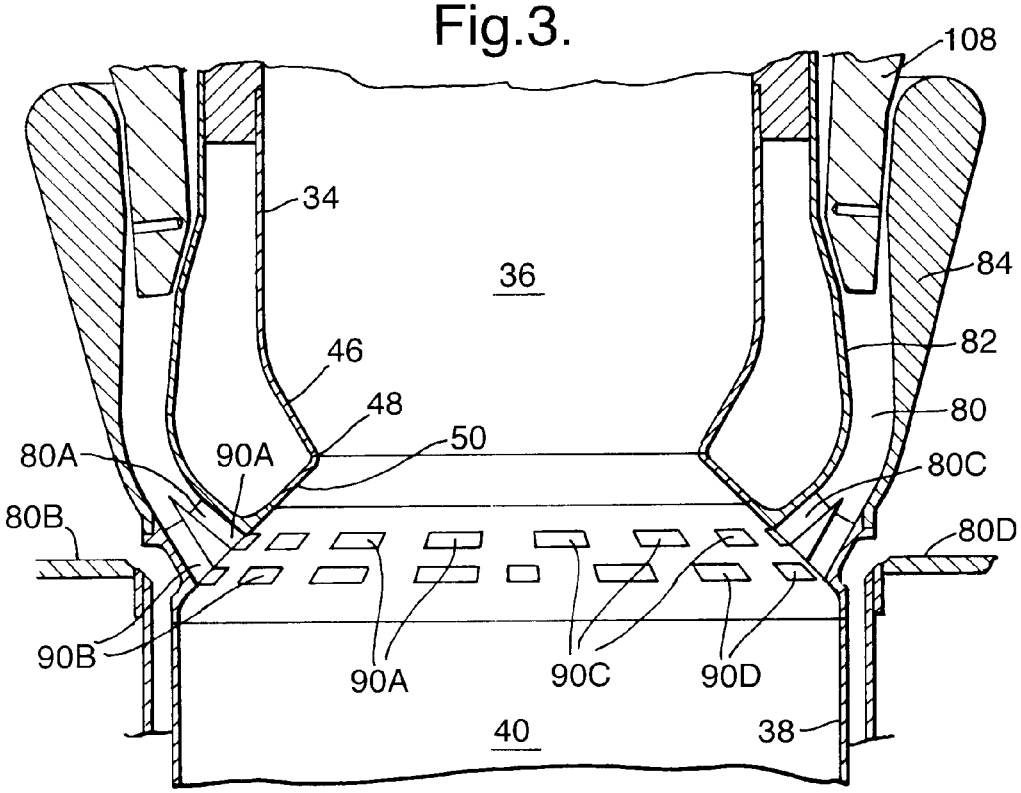
FIG. 3 is an enlarged longitudinal cross-sectional view through the combustion chamber shown in FIG. 2 showing the secondary fuel and air mixing duct.

The secondary fuel and air mixing duct 80 and a portion of the secondary combustion zone 40 is shown more clearly in FIG. 3. The downstream end of the secondary fuel and air mixing duct 80 and the apertures 90 are arranged to increase the axial distribution of fuel and air discharged from the secondary fuel and air mixing duct 80 into the secondary combustion zone 40. Therefore in operation the increased axial distribution of fuel and air increases the axial distribution of the heat released from the combustion process, this is achieved by supplying the fuel and air mixture into the secondary combustion zone at two or more axially spaced positions.

Thus in the left hand side of FIG. 3 the downstream end of secondary fuel and air mixing duct 80 divides into two sets of passages 80A and 80B, or two annular passages, which supply two sets of apertures 90A and 90B respectively. The passages 80A and apertures 90A are arranged to direct the fuel and air mixture into the secondary combustion zone 40 at an angle of approximately 50° to the axis of the tubular combustion chamber 28 and the passages 80B and apertures 90B are arranged to direct the fuel and air mixture into the secondary combustion zone 40 at an angle of approximately 30° to the axis of the tubular combustion chamber 28. The apertures in each of the sets of apertures 90A and 90B respectively are equi-circumferentially spaced and the centres of the apertures 90A and 90B are arranged to lie in common radial planes. It is clear that the fuel and air mixture discharged from the apertures 90A and 90B is distributed over a greater axial distance within the secondary combustion zone 40. Preferably the axial spacing between the two sets of apertures 90A and 90B is arranged such that the distance D is equal to the velocity V of the air/gas flow multiplied by half the period T of one cycle of the noise/vibration. The time period T of once cycle of the noise/vibration is equal to one divided by the frequency F of the pressure fluctuation eg $D=V\times T/2$ and $T=1/F$. This reduces, preferably minimises the amplitude of the pressure fluctuation of that frequency.

In the right hand side of FIG. 3 the downstream end of secondary fuel and air mixing duct 80 divides into two sets of passages 80C and 80D, or two annular passages, which supply two sets of apertures 90 C and 90 D respectively. The passages 80 C and apertures 90 C are arranged to direct the fuel and air mixture into the secondary combustion zone 40 at an angle of approximately 50 degrees to the axis of the tubular combustion chamber 28 and the passages 80 D and apertures 90 D are arranged to direct the fuel and air mixture into the secondary combustion zone 40 at an angle of approximately 30 degrees to the axis of the tubular combustion chamber 28. The apertures in each of the sets of apertures 90 C and 90 D respectively are equi-circumferentially spaced and the centers of the apertures 90 C and 90 D are arranged to lie in different radial planes. Preferably the axial spacing between the two sets of aperture is 90 C and 90 D is arranged such that the distance $D=V\times T/2$ as discussed previously.

Figure 4:
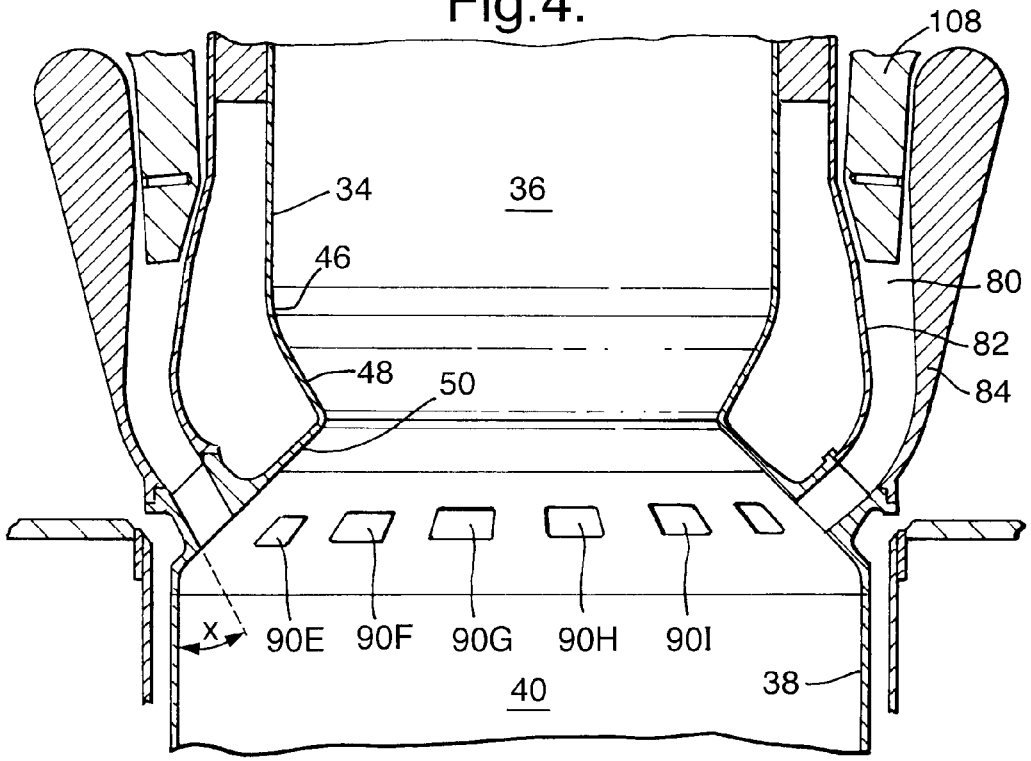
FIG. 4 is an enlarged longitudinal cross-sectional view through the combustion chamber shown in FIG. 2 showing an alternative secondary fuel and air mixing duct.

Another secondary fuel and air mixing duct 80 and a portion of the secondary combustion zone 40 is shown more clearly in FIG. 4. The downstream end of the secondary fuel and air mixing duct 80 and the apertures 90 are arranged to increase the axial distribution of fuel and air discharged from the secondary fuel and air mixing duct 80 into the secondary combustion zone 40. The increased axial distribution of fuel and air increases the axial distribution of the heat released from the combustion process.

Thus in FIG. 4 the downstream end of secondary fuel and air mixing duct 80 divides into a plurality of sets of passages 80E, 80F, 80G, 80H and 80I which supply a corresponding number of sets of apertures 90E, 90F, 90G, 90H and 90I respectively. The passages 80E and apertures 90E are arranged to direct the fuel and air mixture into the secondary combustion zone 40 at an angle of approximately 30° to the axis of the tubular combustion chamber 28. The passages 80F and apertures 90F are arranged to direct the fuel and air mixture into the secondary combustion zone 40 at an angle of approximately 35° to the axis of the tubular combustion chamber 28. The passages 80G and apertures 90G are arranged to direct the fuel and air mixture into the secondary combustion zone 40 at an angle of approximately 40° to the axis of the tubular combustion chamber 28. The passages 80H and apertures 90H are arranged to direct the fuel and air mixture into the secondary combustion zone 40 at an angle of approximately 45° to the axis of the tubular combustion chamber 28. The passages 80I and apertures 90I are arranged to direct the fuel and air mixture into the secondary combustion zone 40 at an angle of approximately 50° to the axis of the tubular combustion chamber 28. The apertures in each of the sets of apertures 90E, 90F, 90G, 90H and 90I respectively are equi-circumferentially spaced and the apertures 90E, 90F, 90G, 90H and 90I are arranged in sequence such the angle of discharge changes progressively at equal angles around the tubular combustion chamber 28. It is clear that the fuel and air mixture discharged from the apertures 90E, 90F, 90G, 90H and 90I is distributed over a greater axial distance within the secondary combustion zone 40.

Figure 5:
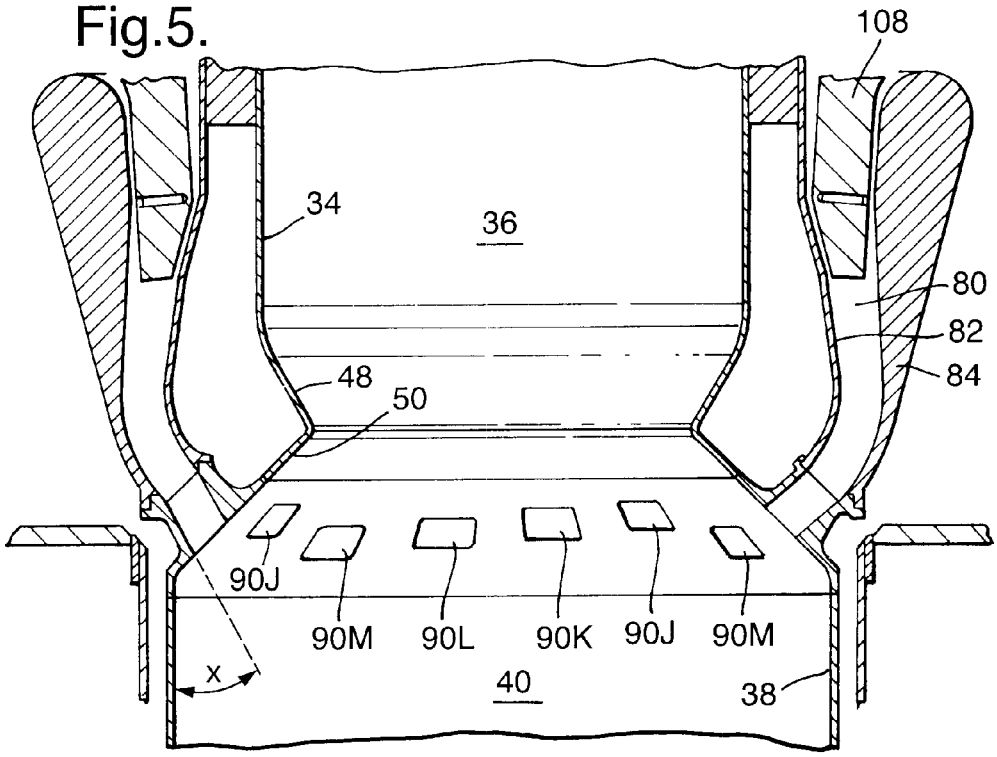
FIG. 5 is an enlarged longitudinal cross-sectional view through the combustion chamber shown in FIG. 2 showing a further secondary fuel and air mixing duct.

It is also possible to have other suitable arrangements of passages 80J, 80K, 80L and 80M and apertures 90J, 90K, 90L and 90M to direct the fuel and air mixture into the secondary combustion zone, for example at angles of 55°, 45°, 35° and 25° as is shown in FIG. 5. Preferably the axial spacing between the sets of aperatures 90E and 90I is also arranged such that the distance $D=V\times T/2$ as discussed above. The apertures 90J, 90K, 90L and 90M are arranged alternately circumferentially so that they form a plurality of spirals of apertures. Preferably the axial spacing between each of the adjacent sets of apertures 90J and 90M is also arranged such that the distance $D=V\times T/2$ as discussed above.

It is also possible to apply the same principle to the tertiary combustion zone 44 and the primary combustion zone.

Figure 6:
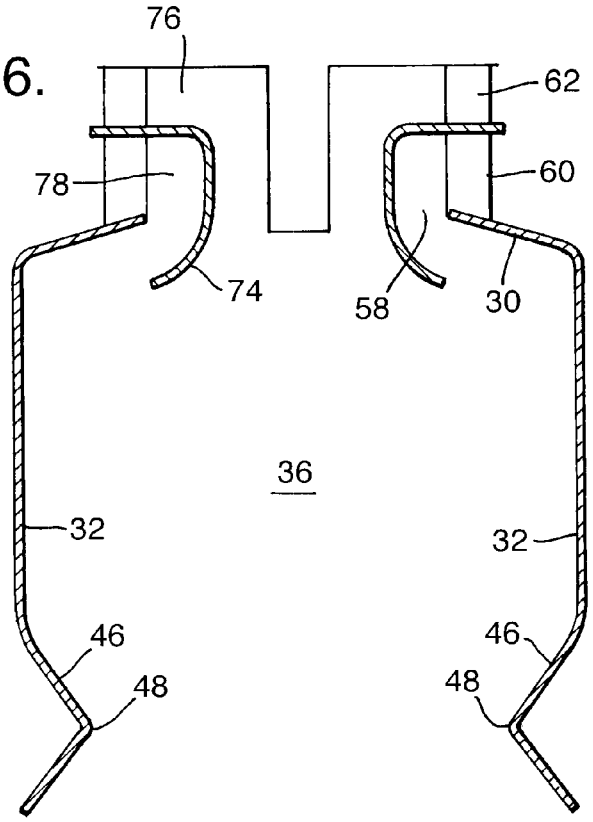
FIG. 6 is an enlarged longitudinal cross-sectional view through the combustion chamber shown in FIG. 2 showing the primary fuel and air mixing duct.

The primary fuel and air mixing ducts 76 and 78 and primary combustion zone 36 are shown in FIG. 6. The left hand side of the figure indicates the invention, whereas the right hand side of the figure shows the existing arrangement. The lip 74 is extended further into the primary combustion zone 36 and extends further towards the first, upstream, wall portion 32. Additionally the length of the first, upstream, wall portion 32 is increased and hence the primary combustion zone 36 is increased to minimise the possibility of overheating.

The invention is also applicable to other fuel and air mixing ducts for example if the primary fuel and air mixing ducts comprise axial flow swirlers.

It is also possible to achieve the same results by using a plurality of fuel and air mixing ducts for each combustion zone and to discharge the fuel and air mixtures from the fuel and air mixing ducts at different axial positions.

The axial spacing between the apertures is therefore selected to reduce the amplitude of the pressure fluctuations at a particular frequency.

I claim:

1. A gas turbine combustion chamber comprising a first combustion zone, a second combustion zone and a third combustion zone, each of said zones having an outer wall, the diameter of the said outer wall of said third combustion zone being larger than the diameter of said outer wall of said second combustion zone and the diameter of the outer wall of the second combustion zone being larger than the diameter of the outer wall of said first combustion zone, the second combustion zone being downstream of the first combustion zone, the third combustion zone being downstream being downstream of both said first and second combustion zones, each said combustion zone having associated means for injecting, directing and distributing a fuel and air mixture into said respective combustion zone, each of said means directing and distributing the fuel and air mixture into each one of said associated said combustion zones being at at least two axially spaced apart locations.

2. A gas turbine combustion chamber comprising a first combustion zone and a second combustion zone, each of said zones having an outer wall, the diameter of the said outer wall of said second combustion zone being larger than the diameter of said outer wall of said first combustion zone, the second combustion zone being downstream of the first combustion zone, each said combustion zone having associated means for injecting, directing and distributing a fuel and air mixture into said respective combustion zone, each of said means for directing and distributing the fuel and air mixture into each one of said associated said combustion zones being at at least two axially spaced apart locations.

3. The gas turbine combustion chamber as claimed in claim 1 wherein said means directing and distributing the fuel and air mixture including apertures in said respective outer wall of at least one of said combustion zones.

4. The gas turbine combustion chamber as claimed in claim 2 wherein said means directing and distributing the fuel and air mixture including apertures in said respective outer wall of said combustion zones.

5. The gas turbine combustion chamber as claimed in claim 1 wherein at least one of said means directing and distributing the fuel includes a duct having a downstream end.

6. The gas turbine combustion chamber as claimed in claim 5 wherein said downstream end of said duct includes a plurality of apertures spaced apart through said outer wall.

7. The gas turbine combustion chamber as claimed in claim 6 wherein a portion of said plurality of apertures is out of axial alignment with one another.

8. The gas turbine combustion chamber as claimed in claim 6 wherein some of said apertures direct the fuel and air mixture at an angle of 50° and other of said apertures direct the fuel and air mixture at an angle of 30° into at least one of said combustion zones.

9. The gas turbine combustion chamber as claimed in claim 6 wherein a portion of said plurality of apertures directs the fuel and air mixture into one of said combustion zones at an angle of 55° and another portion directs the fuel and air mixture into said one of said combustion zones at an angle of 45° and still another portion of said plurality of apertures directs the fuel and air mixture into said one of said combustion zones at an angle of 35°0 and a further portion of said plurality of apertures directs the fuel and air mixture into said one of said combustion zones at an angle of 25°.

10. The gas turbine combustion chamber as claimed in claim 2 wherein at least one of said means directing and distributing the fuel includes a duct having a downstream end.

11. The gas turbine combustion chamber as claimed in claim 10 wherein said downstream end of said duct includes a plurality of apertures spaced apart through said outer wall.

12. The gas turbine combustion chamber as claimed in claim 11 wherein a portion of said plurality of apertures is out of axial alignment with one another.

13. The gas turbine combustion chamber as claimed in claim 11 wherein some of said apertures directs the fuel and air mixture at an angle of 50° and other of said apertures direct the fuel and air mixture at an angle of 30° into at least one of said combustion zones.

14. The gas turbine combustion chamber as claimed in claim 11 wherein a portion of said plurality of apertures directs the fuel and air mixture into one of said combustion zones at an angle of 55° and another portion directs the fuel and air mixture into said one of said combustion zones at an angle of 45° and still another portion of said plurality of apertures directs the fuel and air mixture into said one of said combustion zones at an angle of 35° and a further portion of said plurality of apertures directs the fuel and air mixture into said one of said combustion zones at an angle of 25°.

* * * * *